US011378349B2

(12) United States Patent
Haraldsted et al.

(10) Patent No.: US 11,378,349 B2
(45) Date of Patent: Jul. 5, 2022

(54) GEAR CASSETTE FOR FIREARMS

(71) Applicant: COPENHAGEN INDUSTRIES GLOBAL APS, Copenhagen V (DK)

(72) Inventors: Søren Haraldsted, Copenhagen V (DK); Mie Haraldsted, Copenhagen V (DK); Daniel Karpantschof, Copenhagen V (DK); Frederik Berg, Copenhagen V (DK)

(73) Assignee: Copenhagen Industries Global ApS, Copenhagen V (DK)

( * ) Notice: Subject to any disclaimer, the term of this patent is extended or adjusted under 35 U.S.C. 154(b) by 2 days.

(21) Appl. No.: 16/625,184

(22) PCT Filed: Jun. 21, 2018

(86) PCT No.: PCT/EP2018/066532
§ 371 (c)(1),
(2) Date: Dec. 20, 2019

(87) PCT Pub. No.: WO2018/234428
PCT Pub. Date: Dec. 27, 2018

(65) Prior Publication Data

US 2020/0141673 A1 May 7, 2020

Related U.S. Application Data

(60) Provisional application No. 62/522,723, filed on Jun. 21, 2017.

(30) Foreign Application Priority Data

Feb. 19, 2018 (EP) ..... 18157437

(51) Int. Cl.
*F41A 33/04* (2006.01)
*F41A 33/00* (2006.01)
*F41A 1/04* (2006.01)

(52) U.S. Cl.
CPC ..... *F41A 33/04* (2013.01); *F41A 33/00* (2013.01); *F41A 1/04* (2013.01)

(58) Field of Classification Search
CPC ..... F41A 33/00; F41A 33/04
See application file for complete search history.

(56) References Cited

U.S. PATENT DOCUMENTS 3,346,984 A * 10/1967 Lohr ..... F41A 1/04 42/55
4,654,008 A 3/1987 Elmore
(Continued)

FOREIGN PATENT DOCUMENTS

GB 625230 * 6/1949 ..... F41C 3/04

OTHER PUBLICATIONS

International Search Report and Written Opinion of the ISA for PCT/EP2018/066532 dated Sep. 21, 2018, 11 pages.

*Primary Examiner* — Kurt Fernstrom
(74) *Attorney, Agent, or Firm* — Nixon & Vanderhye P.C.

(57) ABSTRACT

The present invention relates to a gear cassette (1) for firearms, comprising: a trigger unit (3), the trigger unit comprising means for activating firing of the firearm, and a combustion unit (20) comprising: —a combustion chamber part (21) having an inlet end section (22) and an outlet end section (23) and an annular wall (24) arranged between the inlet end section and the outlet end section, the annular wall and the end sections comprising an inner surface (25) and an outer surface (26), at least one gas inlet (31, 32) and a fire outlet (33), and at least one spark plug (34) projecting into the combustion chamber, wherein the combustion unit further comprises a gas hose (6, 7) connected to the gas inlet (31, 32) of the combustion chamber part (21) for bringing the combustion chamber (74) in fluid communication with a gas unit comprising at least one gas container (4, 5), and
(Continued)

Figure 1:
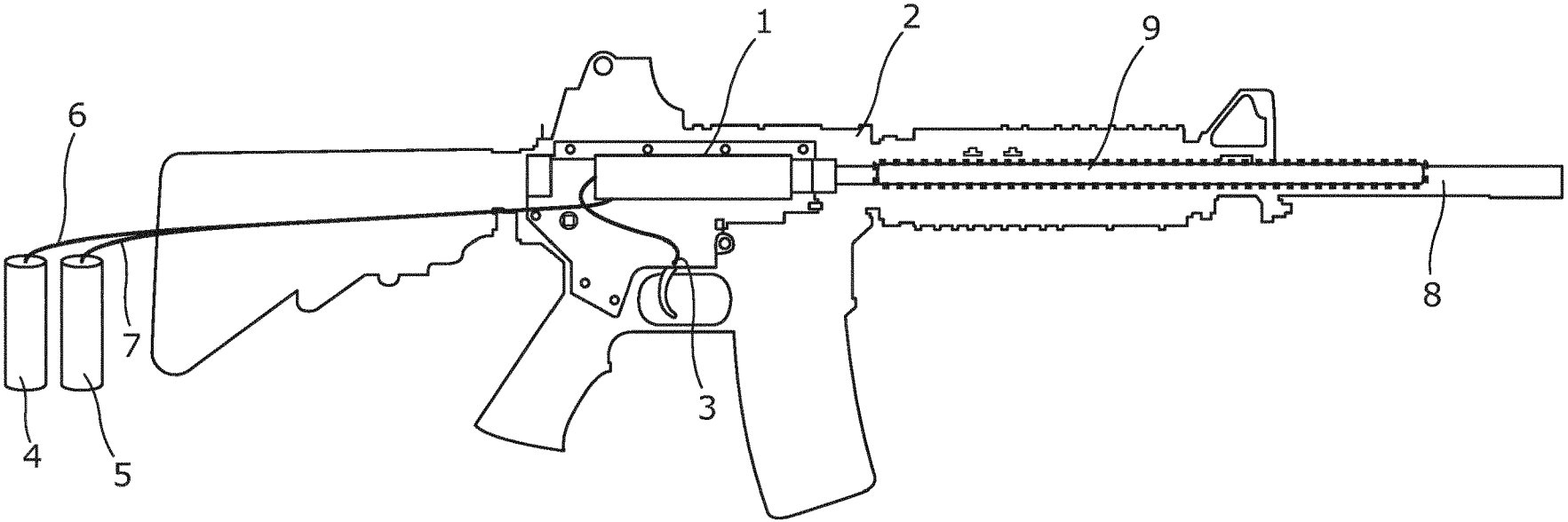

wherein the trigger unit (3) is adapted to activate firing of the firearm by igniting gas in the combustion chamber.

13 Claims, 9 Drawing Sheets

(56) References Cited

U.S. PATENT DOCUMENTS

| | | | | | |
|---|---|---|---|---|---|
| 4,662,844 | A * | 5/1987 | Gallagher | F41A 33/04 | 434/16 |
| 4,664,631 | A * | 5/1987 | Pederson | F41A 33/04 | 434/16 |
| 5,941,709 | A * | 8/1999 | Denchfield | F41A 33/04 | 434/16 |
| 5,944,502 | A * | 8/1999 | Denchfield | F41A 33/04 | 431/1 |
| 9,464,860 | B2 * | 10/2016 | Wilson | A01K 15/02 | |
| 9,777,981 | B1 * | 10/2017 | Bower | F41A 33/04 | |
| 10,702,786 | B2 * | 7/2020 | Hugill | G10K 15/04 | |
| 2015/0121739 | A1 * | 5/2015 | Wilson | A01K 15/02 | 42/90 |

* cited by examiner

GEAR CASSETTE FOR FIREARMS

This application is the U.S. national phase of International Application No. PCT/EP2018/066532 filed Jun. 21, 2018 which designated the U.S. and claims priority to U.S. Provisional Application No. 62/522,723 filed Jun. 21, 2017 and EP Patent Application No. 18157437.7 filed Feb. 19, 2018, the entire contents of each of which are hereby incorporated by reference.

The present invention relates to a gear cassette for firearms. Furthermore, the present invention relates to a replica firearm comprising a gear cassette according to the present invention and to use of such replica firearms in a moving film or still pictures.

When making a film that includes scenes with shooting of firearms, a wide number of considerations are necessary in order to maintain the required level of safety while bearing in mind the financial aspects of achieving this safety. Often scenes including shooting of firearms are expensive because of the safety required by the authorities as well as by the actors and staff. Traditionally, when making such scenes, i.e. shooting a firearm it is obvious that the firearms are equipped with "blank" ammunition, i.e. having no projectiles and nothing but gas is exiting the barrel. Unfortunately, this does not bring a film crew even close to ensuring the required safety. This is due to several possibilities of human or mechanical mistakes that could occur. If for instance live ammunition were taken for blank ammunition, it is obvious that this could lead to a catastrophic situation. Hence, the mere presence of a firearm that potentially could be used with live ammunition constitutes a dangerous situation in itself. Therefore, e.g. in Denmark, it is required that a person having a weapons permit for the firearm in question needs to watch and at all time be aware of the exact location of the firearm. Furthermore, scenes may be required to be taken in specific studios i.e. in fully controlled settings which again is costly. When watching a movie in the cinema, the sound heard from firearms fired are digitally edited into the movie. However, in real life, firing a firearm typically makes a noise of approximately 180 dB and is therefore directly hazardous to the hearing of user and crew—as an example of this, the actor Bruce Willis lost ⅔ of his hearing on one ear during the recording of a Die Hard movie. Therefore, what seems to be minor details, such as e.g. the need for wearing ear protection even when firing blanks, may be costly when a full film crew needs ear protection—maybe even for a very short time, but nevertheless, it is the law or at least necessary according to standards in the filming industry.

Manufacturing full scale firearms for this particular purpose (filming) is not cost-efficient.

Hence, there is a need for a combustion gear cassette for firearms which is completely safe in terms of not being able to fire live ammunition and which still provides the actor with the sensation of holding and firing a real firearm. Finally, the film audience should be convinced that the firearm is an actual firearm.

It is an object of the present invention to wholly or partly overcome the above disadvantages and drawbacks of the prior art. More specifically, it is an object to provide an improved and safer physical simulation of live firing or blank firing of firearms.

The above objects, together with numerous other objects, advantages and features, which will become evident from the below description, are accomplished by a solution in accordance with the present invention by a gear cassette for firearms, comprising:

a trigger unit, the trigger unit comprising means for activating firing of the firearm, and a combustion unit comprising:

a combustion chamber having an inlet end section and an outlet end section and an annular wall arranged between the inlet end section and the outlet end section, the annular wall and the end sections comprising an inner surface and an outer surface, at least one gas inlet and a fire outlet, and at least one spark plug projecting into the combustion chamber, wherein the combustion unit further comprises a fluid connection connected to the gas inlet of the combustion chamber for bringing the combustion chamber in fluid communication with a gas unit comprising at least one gas container, and wherein the trigger unit is adapted to activate firing of the firearm by igniting gas in the combustion chamber.

In this way, it is achieved that the firearm simulates firing of the firearm by projecting a nozzle fire from the barrel. The fire outlet lets fire escape from the combustion chamber and a flame seen at the end of the muzzle is created. Furthermore, due to a low noise from the firearm a short required safety distance is achieved e.g. less than one metre and even as low as 0.5 metres. When firing of blank shooting firearms using traditional blank ammunition, a safety distance of 3-15 metres is required. The possibility to aim a firearm using the present invention directly at people or equipment without any risk is furthermore achieved.

The terms "gear cassette" or "chamber cassette" are often used for a unit comprising e.g. a gear, a trigger, a chamber and various other components. However, it will be understood that the gear-cassette in the present invention may comprise different components than a traditional gear cassette and hence be a "component cassette" and may not necessarily comprise a gear as such but "gear" in general.

When making a film, the cameras are obviously very expensive. Traditional firing of blanks with real firearms requires a safety distance of 10 metres to the camera. However, using the combustion gear cassette of the present invention, the safety distance may be reduced to as low as 0.5 metre.

The inlet end section and the outlet end section may be opposing each other. In this way, it is possible to have an inline flow through the combustion chamber.

The overall outer shape of the combustion chamber may be barrel-shaped.

Moreover, the inlet end section may comprise two gas inlets.

In this way, it is possible to have an additional gas container/canister connected to the combustion unit, either for supply of additional gas of the same type or for the supply of a second type of gas, e.g. for obtaining a mix of a specific gas and oxygen.

In an embodiment, the gas container(s)/canister(s) may be arranged externally in a bag, e.g. a "fanny pack", shoulder bag or similar.

In this way, changing an empty canister to a full canister is made easy for both the user of the firearm and/or the supporting crew.

In a further embodiment, the canister(s) may be arranged in the firearm itself e.g. in the body of the firearm or in the ammunition magazine. In this way, it may be possible store more canisters in the firearm as well as store them in the most convenient place.

Furthermore, the combustion unit may comprise a mixing chamber arranged between the gas inlets and the combustion chamber i.e. downstream from the gas inlets.

In this way, it is possible to mix e.g. oxygen and gas to ensure a good combustion.

In addition, the outer surface of the combustion chamber may comprise heat dissipation means.

In this way, it is possible to guide more heat from the walls of the combustion chamber to the surroundings.

Also, the outlet end section may comprise a projecting fire stud or fire barrel from the outer surface of the outlet end section, whereby the fire stud or barrel is in fluid communication with the combustion chamber.

In this way, it is possible to focus the explosion from the combustion chamber in a desired direction, e.g. towards the muzzle of a firearm.

Further, the spark plug may be arranged in the inlet end section of the combustion chamber.

In this way, it is achieved that the general diameter of the combustion unit is kept as small and as even as possible. In this way, it is easier to install and adapt to various firearms.

In an embodiment, the combustion chamber and/or the gas hose(s) may further comprise at least one solenoid valve for opening and shutting the flow of gas to the combustion chamber.

Moreover, the fire barrel/fire stud and/or the combustion chamber may comprise an injector arranged to inject a fluid into the fire barrel/fire stud and/or the combustion chamber.

In this way, it is possible to inject e.g. sodium dissolved in water in order to get a more yellow flame.

Furthermore, the combustion unit may comprise at least one further gas inlet, and the connection for the first gas container/hose and the connection for the second gas container/hose may be different.

Also, the combustion unit may comprise a gas mixing chamber for mixing the first gas and the second gas, e.g. a gas and oxygen. In this way, it is possible to ensure that the types of gas are mixed in a desired way before entering the combustion chamber. Hence, a better combustion is ensured.

Further, the combustion unit may comprise more than one solenoid, and the solenoid valves may stay open in different time intervals. In this way, it is possible to allow for mixing two types of gas with different volume in a desired ratio.

The pressure in the first gas container and the second gas container may be different.

In this way, it is possible to achieve a specific ratio of gas mixture and still have the solenoid valves stay open for the same time interval.

The present invention also relates to a replica firearm comprising a chamber gear cassette according to the present invention.

Furthermore, the present invention relates to use of a replica firearm according to the present invention in a moving film, in theatres, still pictures or during military/police training sessions.

A fire barrel may be detachably connected to the outlet end section of the combustion chamber. In this way, it is possible to use the same combustion unit to be inserted in several types of firearms having e.g. different lengths and/or different diameters of fire barrel.

In an embodiment, the heat dissipation means may be fins or a corrugated outer surface of one or more outer surfaces of the combustion chamber. In this way, the total outer surface area is increased and heat dissipation is increased.

Also, the spark plug may be arranged through the annular wall of the combustion chamber. Said spark plug may be in the form of an ignition generator. In this way, it is possible to reduce the space needed for igniting the gas.

Additionally, the gas container may be canisters, e.g. gas canisters each comprising connection means for connecting to the gas hoses or gas inlet(s).

The combustion unit may comprise pressure transducers or similar for gauging and/or communicating the content of the gas containers/canisters.

The gear cassette according to the present invention may further comprise a control unit for controlling the solenoid(s) and/or the ignition.

Moreover, the trigger unit may comprise a battery. The battery for the trigger unit may be stored in the fanny pack. In this way, it is possible to change and/or recharge the battery without disassembling the firearm. The trigger unit may be located outside the firearm e.g. in fanny pack. In this way, it is possible to keep the firearm as simple as possible by having the most electrical components in a fanny pack. It is to be understood that the actual triggering of the firearm i.e. the initiation of flow of gas and ignition of gas may be controlled externally. Hence, the trigger unit may not comprise a physical trigger similar to that of a revolver.

The hoses may comprise inserts of metal. In this way, it is possible to control or stop the spreading of heat from the combustion chamber via the hoses. The insert may be of e.g. brass, copper or an alloy, i.e. a material with a high capability to transfer heat.

The fire barrel may be manufactured from stainless steel, brass or high grade steel. The fire barrel may be manufactured from a material that resists the heat and pressure generated by the combustion of the gas(ses).

Also, the gear cassette may further comprise a computer. In this way, it is possible to control the ignition as well as the opening and closing of solenoids.

Furthermore, the gear cassette according to the present invention may comprise communication means, e.g. Wi-Fi, Bluetooth or similar. In this way, it is possible to adjust the actions of the gear cassette to the actions of other devices. Furthermore, the computer and the communication means may be connected in such way that the settings of the gear cassette may be changed over the air (OTA).

In a further embodiment, both the gear cassette and/or a fanny pack may comprise a computer or PCB's for controlling the functions of the firearm. In this way, it is possible to have some functions as stand alone functions in the firearm as well as some functions incorporated between the gear cassette and the external fanny pack. In this way, an electronically controlled system for producing a muzzle flash comparative to blank firing firearm.

The gas hoses may be gas conduits or gas tubes. It will be understood that some embodiments of the invention may comprise a mix of hose parts, conduits and tube parts although only one type is mentioned. The gas hoses may be connected and disconnected at the buttstock of the firearm. The connectors for connecting the gas hoses may be different. In this way, prevention of the unintentional mixing of gases is achieved.

The gas hoses may have different size i.e. different inner diameter. In this way, it is possible to control the flow ratio between two canisters.

The gear cassette and/or the firearm may comprise identification means for ensuring that the correct canisters and PCB are used for the firearm at hand.

In an embodiment, heating means may surround the canisters. In this way, it is possible to keep the canisters at a desired temperature.

In addition, the combustion chamber may consist of more than one part where the parts are e.g. screwed, welded or glued together. In this way, it is possible to perform maintenance of or interchange just one part of the combustion chamber.

The ratio between the amount of a first and a second gas may be from 1:2-1:100 or 1:3-1:50 or 1:4-1:25.

Figure 2:
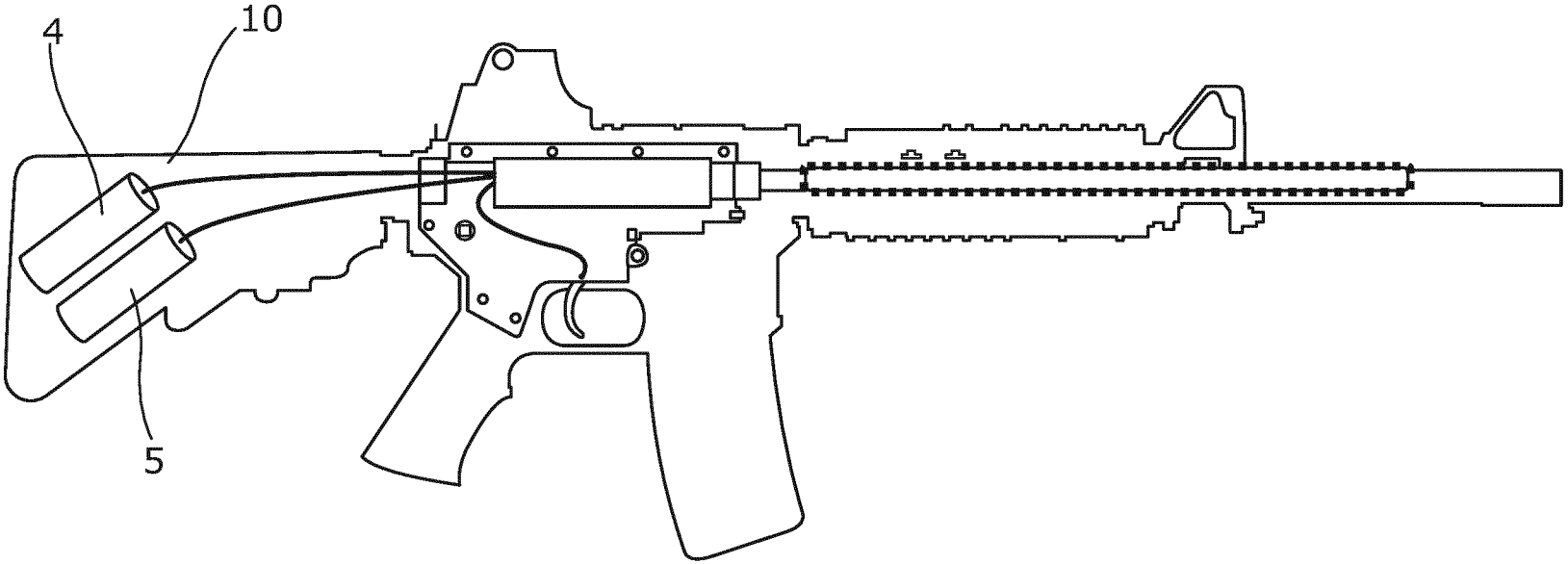
Figure 3:
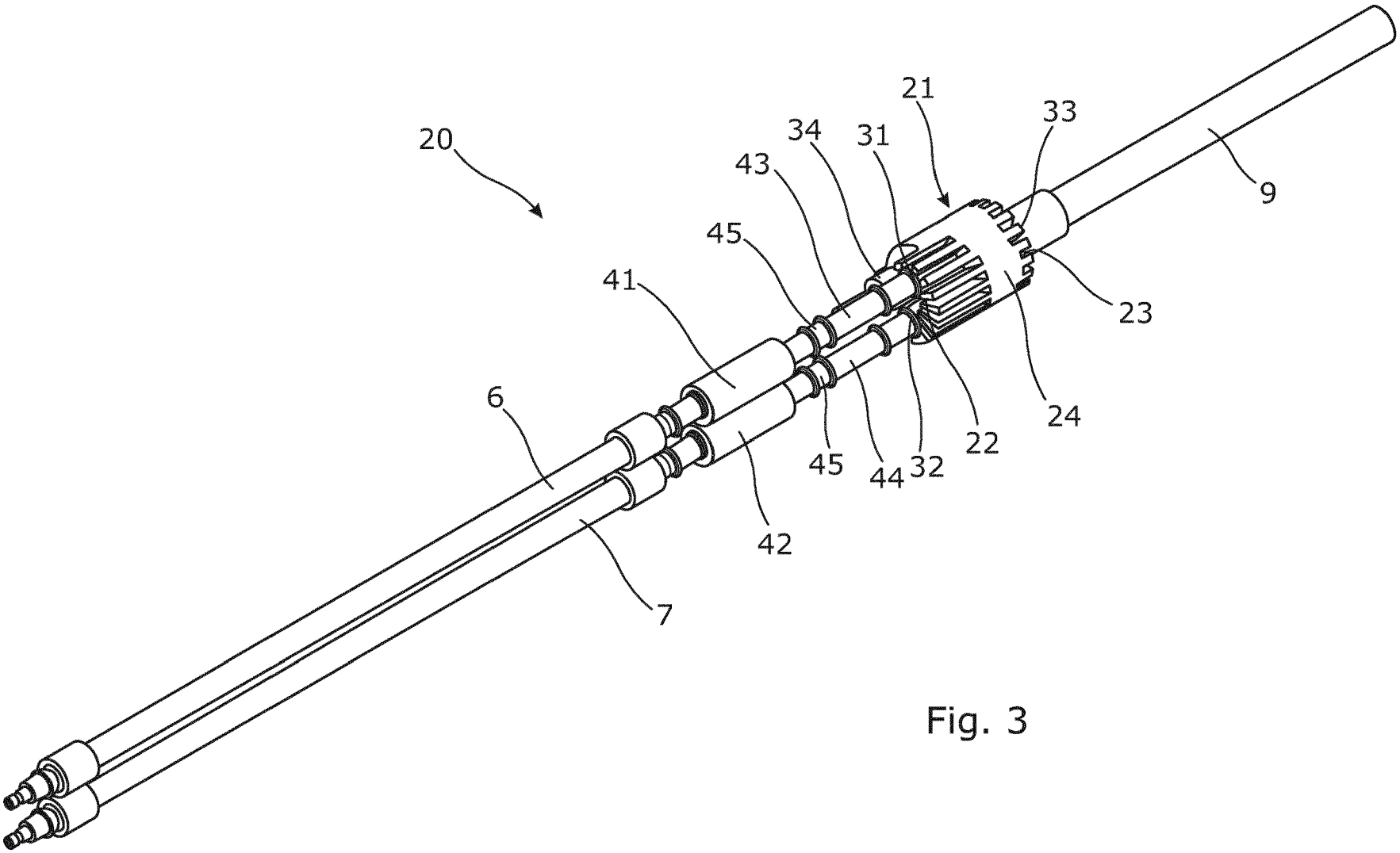
Figure 4:
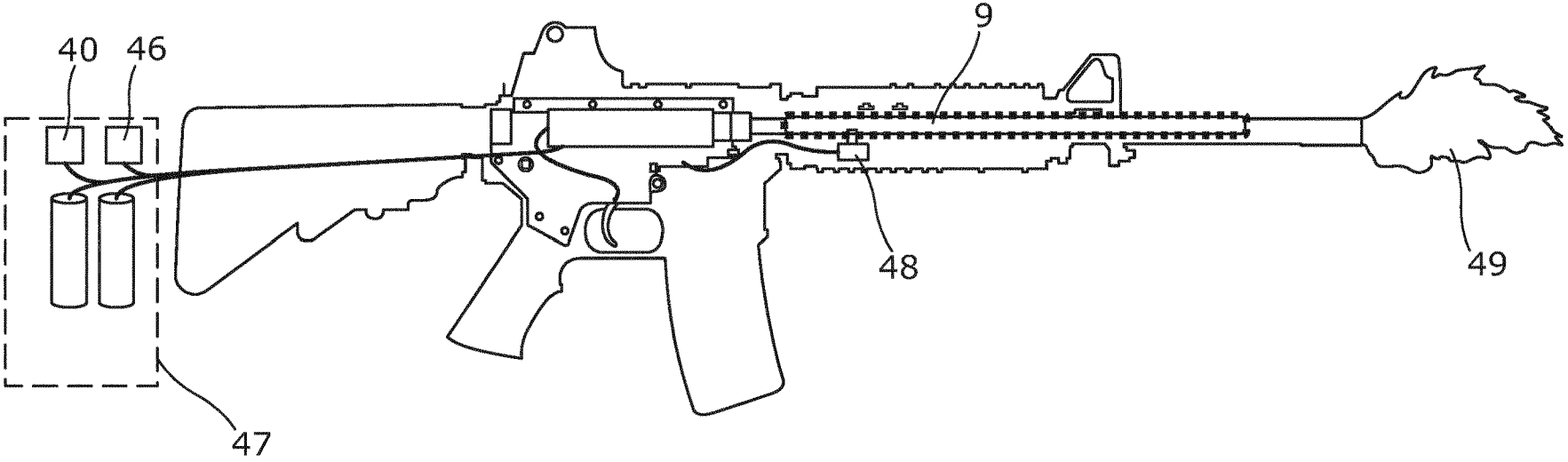
Figure 5:
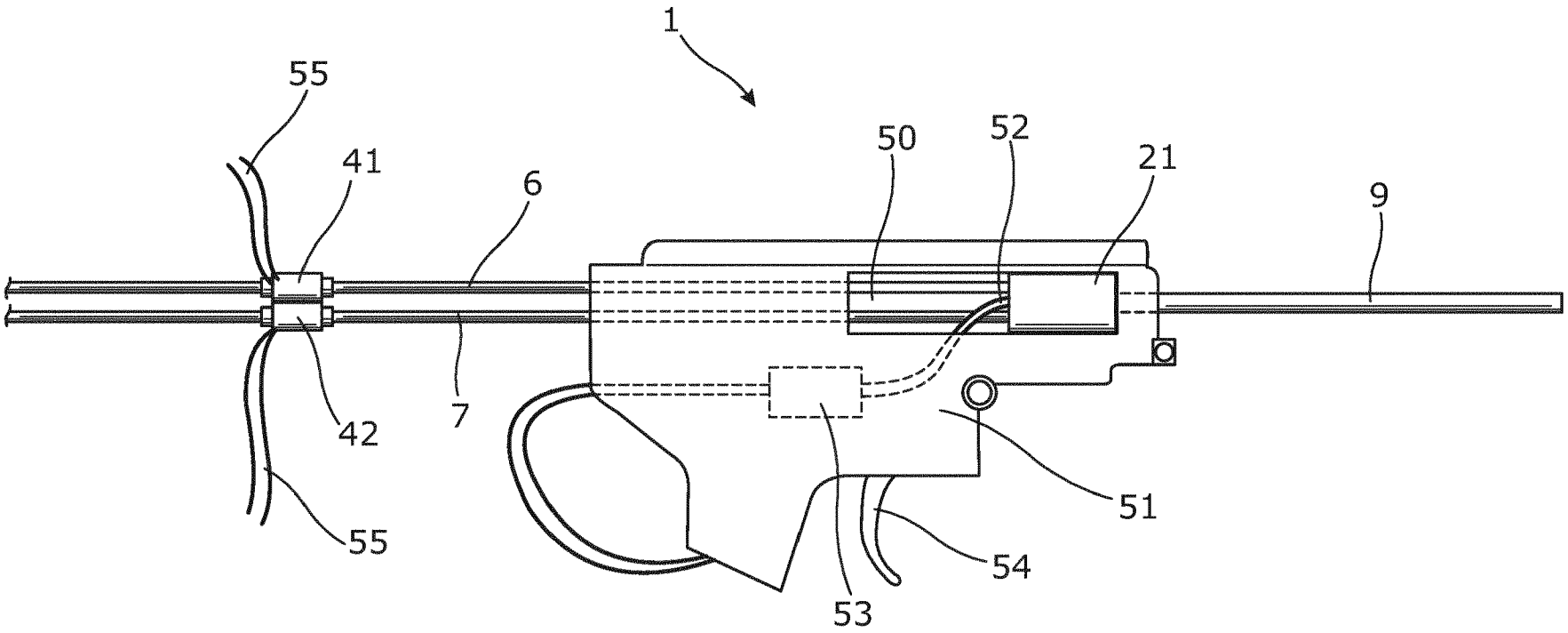
Figure 6A:
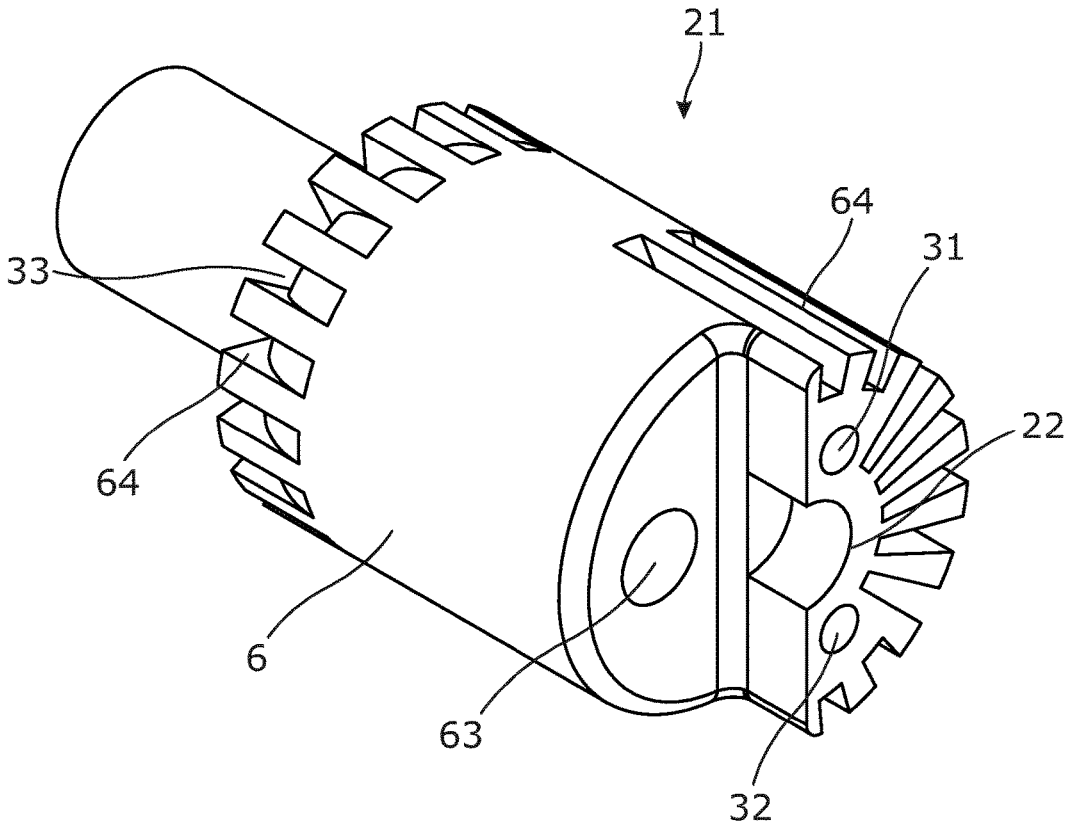
Figure 6B:
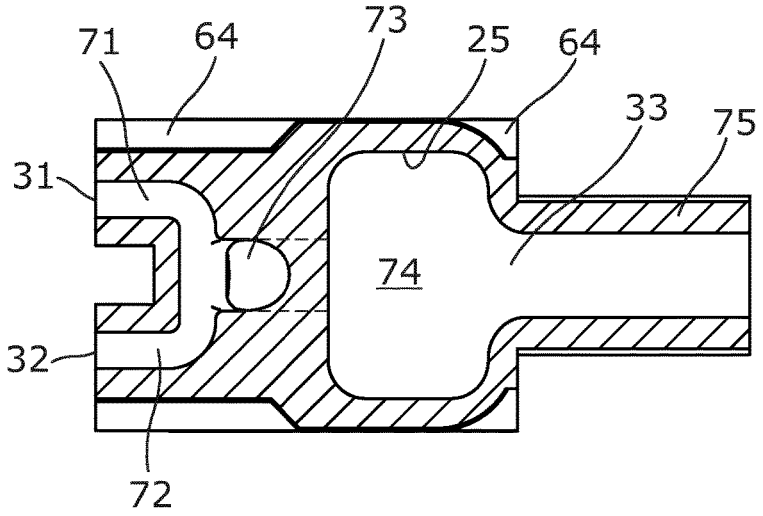
Figure 6C:
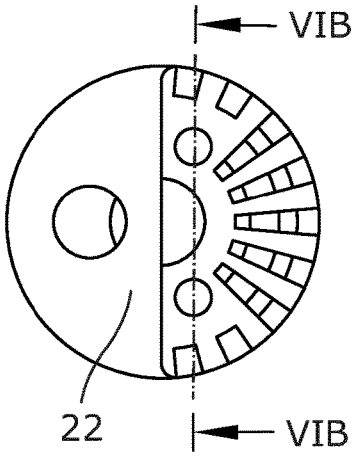
Figure 6F:
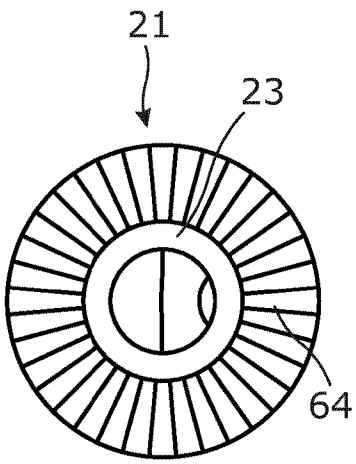
Figure 6D:
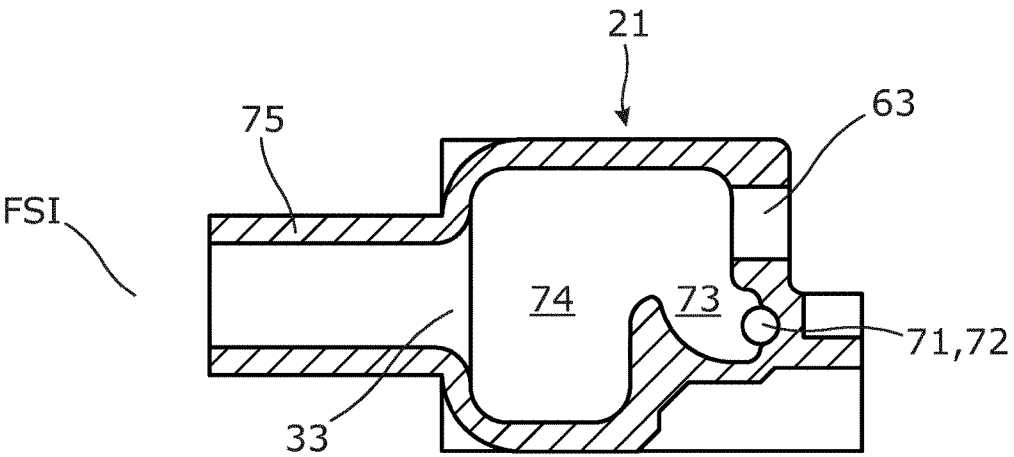
Figure 6E:
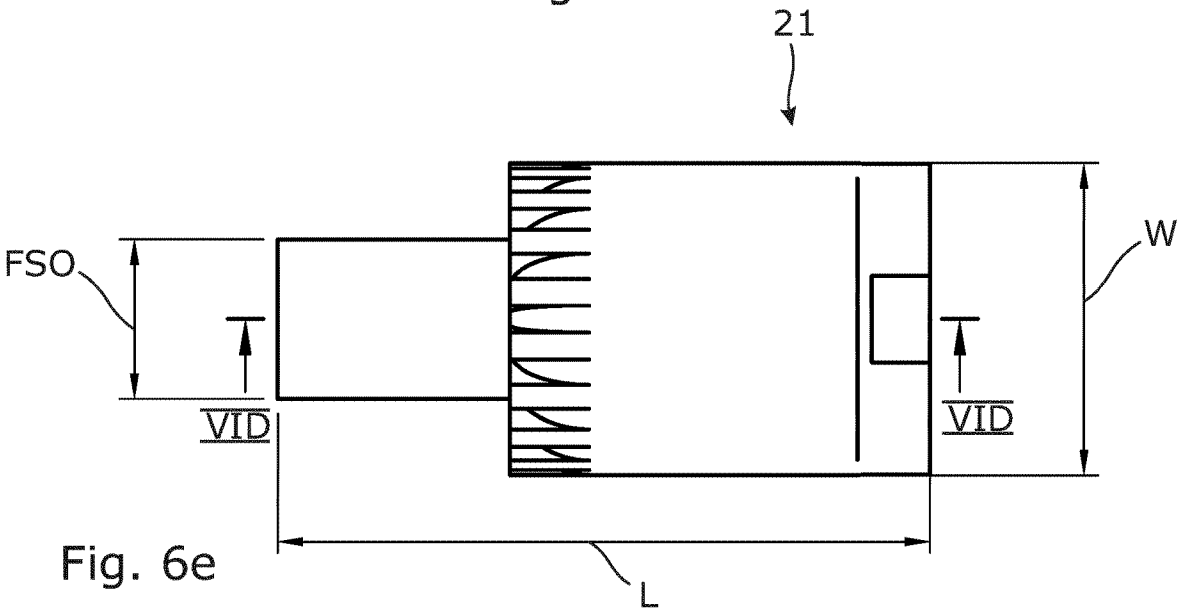
Figure 7A:
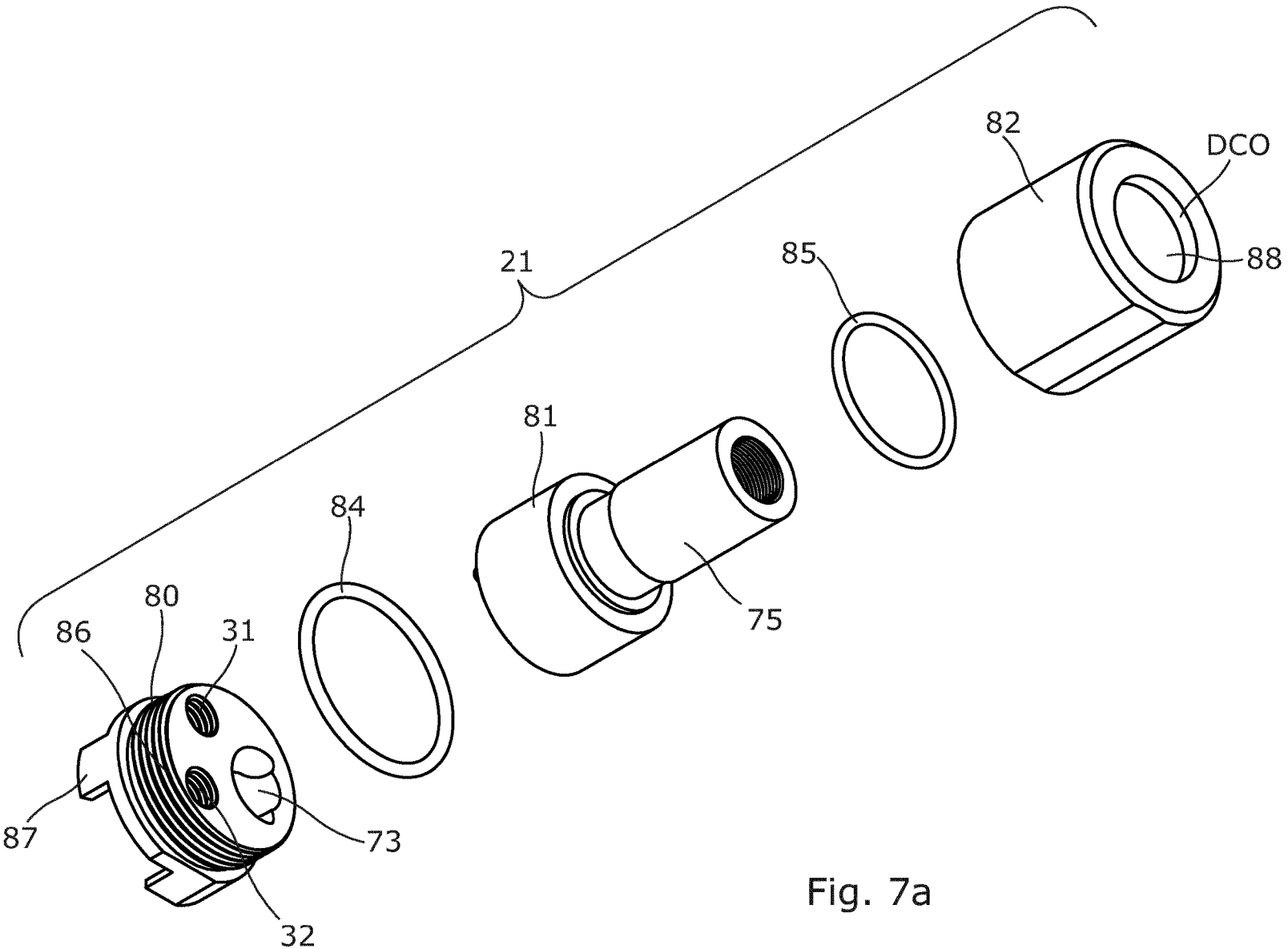
Figure 7B:
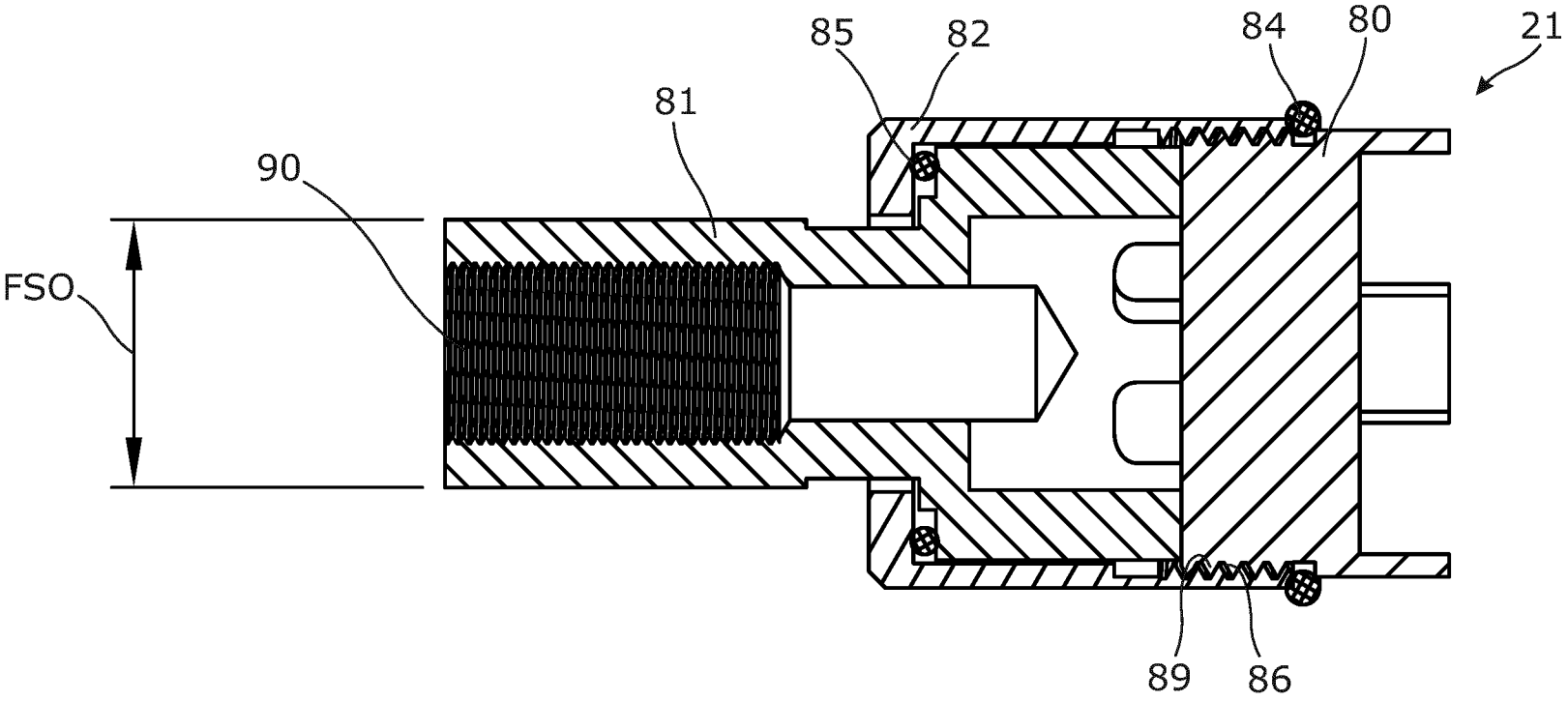

The invention and its many advantages will be described in more detail below with reference to the accompanying schematic drawings, which for the purpose of illustration show some non-limiting embodiments and in which:

FIG. 1 shows in a partly transparent view a firearm having a gear cassette according to the invention installed in the body of the firearm, FIG. 2 shows a firearm comprising the gear cassette as in FIG. 1 having internal containers for gas, FIG. 3 shows a combustion unit having two gas inlets, FIG. 4 shows the firearm of FIG. 1 including a fanny pack and flame from the nozzle, FIG. 5 shows a gear cassette according to the invention, FIGS. 6A-6F show an embodiment of the combustion chamber, and FIGS. 7A-7B show another embodiment of the combustion chamber.

All the figures are highly schematic and not necessarily to scale, and they show only those parts which are necessary in order to elucidate the invention, other parts being omitted or merely suggested.

FIG. 1 shows a gear cassette 1 arranged in a firearm 2. The gear cassette 1 comprises a trigger unit 3. The trigger unit 3 comprises means for activating firing of the firearm 2. The firearm 2 is shown having a first gas canister 4 and a second gas canister 5 arranged outside the stock of the firearm 2. The gas canisters 4, 5 are in fluid communication with the combustion chamber (not shown) by a first gas hose 6 and a second gas hose 7. It is to be understood that the gas considered may be various gasses, e.g. propane in the one canister and oxygen in the other canister. The firearm further comprises a firearm barrel 8. At least partly inside the hollow firearm barrel 8, a fire barrel 9 projects from the combustion chamber (not shown). In FIG. 1, the fire barrel 9 is indicated by dotted lines.

The canisters 4, 5 may be carried by the person in a bag or fanny pack (not shown). The canisters 4, 5, may also simply be arranged in a pocket in the clothing of the user or similar.

FIG. 2 shows a firearm 2 similar to that shown in FIG. 1. However, in this embodiment, the two gas canisters 4, 5 are arranged in the stock 10 of the firearm 2. In a further embodiment, the canister(s) may be arranged in the firearm itself e.g. in the body of the firearm or in the ammunition magazine (not shown).

FIG. 3 shows a combustion unit 20. In this embodiment, the combustion unit 20 comprises a combustion chamber part 21 having an inlet end section 22 and an outlet end section 23 and an annular wall 24 arranged between the inlet end section 22 and the outlet end section 23. The annular wall and the end sections 22, 23 comprise an inner surface (not shown, shown in a later figure) substantially defining a combustion chamber and an outer surface 26.

The combustion chamber part 21 further comprises a first gas inlet 31 and a second gas inlet 32 and a fire outlet 33. Furthermore, a spark plug 34 is arranged in the inlet end section 22. The spark plug 34 is arranged so as to project into the combustion chamber.

FIG. 3 further shows that two gas hoses 6, 7 are connected to the gas inlets 31, 32. The gas inlets 31, 32 provide fluid communication from outside the combustion chamber to the combustion chamber. The first gas hose 6 comprises a first solenoid valve 41 and the second gas hose 7 comprises a second solenoid valve 42. Furthermore, both gas hoses 6, 7 comprise a tube insert of metal 43, 44. The metal tube inserts 43, 44 are arranged in the gas hoses in order to protect the gas hoses against the heat from the combustion chamber. In this embodiment, each of the gas hoses further comprises a non-return valve 45, e.g. a duck bill or similar. The return valves 45 serve to stop back firing from the combustion chamber. Hence, it is preferred that the non-return valves 45 are arranged between the combustion chamber and e.g. a softer section of the gas hoses and/or between the combustion chamber and the solenoid valves 41, 42 in order to protect these from heat. The non-return valves may be one-way valves.

The gas hoses 6, 7 facilitate fluid communication from the canisters (not shown) to the gas inlet 31, 32 of the combustion chamber part 21 for bringing the gas into the combustion chamber. When the fluid is led to the combustion chamber, it is possible to initiate combustion in the combustion chamber by activating the spark plug 34. The activation of the spark plug 34 is carried out by the trigger (shown in FIG. 1). Hence, when the trigger unit is adapted to activate firing of the firearm by igniting gas in the combustion chamber, a firing of the firearm is achieved. In a typical manner for combustion, the gas will expand and hence create a blast through the outlet 33 into the fire barrel 9.

It is shown that the inlet end section 22 and the outlet end section 23 are opposing each other. In this way, it is possible to have an inline flow through the combustion unit 20. The overall outer shape of the combustion chamber part 21 may be barrel-shaped. Both the barrel shape and the inline configuration ensure that the combustion unit 20 is easy to install in a gear cassette as well as in firearms that typically have an elongated shape.

FIG. 4 shows the firearm 2 similar to that of FIG. 1. The external canisters 4, 5 and a battery 40 and a PCB 46 are positioned in a fanny pack 47. Furthermore, it is seen that an injector 48 is arranged to inject a substance into the fire barrel 9. The substance may e.g. be a solution of sodium and water i.e. saltwater. Injecting a substance like this facilitates changing of the colour of the muzzle flame 49. When using e.g. propane and oxygen as gas, the flame may be rather blue. When using gun powder, i.e. live ammunition, the colour of the flame is in the yellow range. Hence, it is desired to be able to change the colour of the flame according to the specific firearm and live ammunition it is simulating. In this way, it is achieved that the firearm 2 visually fully simulates firing of blank ammunition and live ammunition as well. The substance injector 48 may also be arranged to be injected directly into the combustion chamber. The coloured flame will be directed through the fire outlet which lets fire/flame escape from the combustion chamber and the flame 49 is seen at the end of the muzzle.

FIG. 5 shows an embodiment of the gear cassette 1 where the combustion unit 20 shown in FIG. 3 is mounted in the gear cassette 1. It is to be understood that the outer outline of the gear cassette 1 could vary in many ways in order to fit into a specific firearm. Hence, contour of the gear cassette shown in FIG. 3 is merely one embodiment. The combustion chamber part 21 is arranged in an opening 50 of the cassette body 51 of the gear cassette 1. The fire barrel 9 is connected to the combustion chamber part 21 and projects from the cassette body 51 of the gear cassette 1 through an opening in the cassette body 51. Gas hoses 6, 7 extend from the combustion chamber part 21 through a part of the cassette body 51 and out of the cassette body 51 for connecting to the gas containers (not shown). It is seen that the opposing inlet end section and outlet end section facilitate an overall stretched shape of the combustion unit 20 rendering it generally easy to fit into firearms. Two solenoid valves 41, 42 are shown in the hoses positioned outside the cassette body 51. However, they may also be positioned on the hoses inside the cassette body. A wire 52 is shown connected to the combustion chamber part 21. The wire 52 connects to the spark plug (not shown) or another ignition generator and a power source 53. The power source 53 may simply be a battery or a high voltage generator connected to a battery. The trigger unit 3 comprises a trigger 54 for activating firing of the firearm. Via the wires 55, the solenoid valves are controlled. The wires 55 to the solenoid valves may be connected directly to the trigger unit 3 or to a PCB comprising a computer arranged elsewhere, e.g. in the stock or in a fanny pack.

FIGS. 6A-F show an embodiment of the combustion chamber part 21 in various views. FIG. 6A is a perspective view of the combustion chamber part 21. The inlet end section is shown having a first and a second gas inlet 31 and 32 for inlet of gas to the combustion chamber and further an ignition aperture 63 arranged to receive ignition means, e.g. a spark plug. The inlet end section 22 and the outlet end section 23 both comprise heat dissipation means 64. In this embodiment, the heat dissipation means 64 are fins for increasing the total outer surface of the combustion chamber part 21. Extending from the outlet end section 23, the fire outlet 33 is seen.

FIG. 6B is a cross sectional view of the combustion chamber part 21. It is shown that the gas inlets 31, 32 continue in the combustion chamber part 21 via two conduits 71 and 72 into a mixing chamber 73. The mixing chamber 73 is arranged between the gas inlets and the combustion chamber 74 and ensures a mixing of gas of the different gas supplied. The mixing chamber 73 then leads the mixed gas to the combustion chamber 74. In the combustion chamber 74, the actual explosion of the gas or mixed gas is initiated by the ignition means, i.e. the spark plug (not shown) and the fire/flame is led out of the combustion chamber through the fire outlet 33 and into a fire stud 75 and/or a fire barrel (not shown). Hence, a fluid communication is achieved from the gas inlets 31, 32 to the fire outlet 33.

FIG. 6C shows the inlet end section 22. In order to better understand the cross-sectional view shown in FIG. 6B, it is indicated by arrows where the cross sectional plane is seen.

FIG. 6D is a further cross-sectional view of the combustion chamber part 21 seen orthogonally to the view in FIG. 6C. In this view, it is better shown that the mixing chamber 73 is in fluid communication with the combustion chamber 74. A delimiting wall 76 facilitates that the flow of gas from the two gas inlets 31, 33 is forced to change direction, i.e. changing the direction substantially 90°, and by this a better mixing of the gasses is achieved. Furthermore, the delimiting wall may create a back wall in the combustion chamber 74 focusing the exit path of the explosion in the combustion chamber 74 towards the outlet 33 and further into the fire stud 75. The inner diameter FSI of the fire stud may be from 1 mm-15 mm. The fire stud 75 may comprise a thread or other means for connecting a fire barrel to the fire stud 75.

FIG. 6E shows a further view of the combustion chamber part 21 in order to show the position of the cross-sectional view of FIG. 6D. Furthermore, it is shown that the heat dissipation means 64 extend partly along the longitudinal axis of the combustion chamber part. The length L may be from 10 mm-150 mm. The outer diameter of the fire stud may be from 3 mm-30 mm. The width of the combustion chamber part 21 i.e. the radius when the combustion chamber part is barrel-shaped may be from 3 mm-500 mm.

FIG. 6F shows a view of the combustion chamber part 21 seen from the outlet end part direction. In this view, it is shown that the heat dissipation means, i.e. the cooling fins, extend radially and are equidistantly arranged.

FIGS. 6A-6F all show the combustion chamber part 21 as one solid part. This is achievable, e.g. by casting, sintering, 3D printing or advanced milling techniques. The material may be stainless steel or similar materials/alloys withstanding the temperatures in the combustion chamber.

FIGS. 7A and 7B show an embodiment of the combustion chamber part 21 where the combustion chamber part consists of a number of parts. In this way, it is facilitated that maintenance of the combustion chamber is possible. Furthermore, it is possible to adapt the size of the combustion chamber or the properties of the inlets/outlet to specific needs.

FIG. 7A shows an inlet end section 22 as an inlet part 80, an intermediate combustion chamber part 81 and a cover part 82. This embodiment further comprises a first and a second O-ring 84, 85 for ensuring a fluid tight connection between the parts. In inlet part 80 it is shown that it comprises a mixing chamber 73 and a first gas inlet 31 and a second gas inlet 32. Furthermore, the inlet part 80 comprises a thread 86 arranged to threadingly engage with a corresponding thread on the cover part 82. The inlet part further comprises a number of projections for ensuring a firm grip during rotating the parts in order to mount the inlet part 80 with the intermediate combustion chamber part 81 and the cover part 82. The cover part 82 has an opening 88 with a diameter DCO arranged to be able to receive the fire stud 75 of the intermediate combustion chamber part 81.

FIG. 7B shows a cross-sectional view of the multiple part combustion chamber part 21 in its assembled state. It is shown that the intermediate combustion chamber part 81 is brought into contact with the inlet part 80 and the two parts are kept together by the cover part 82. The cover part 82 is secured to the inlet part 80 by means of the thread 86 on the inlet part 80 and an internal thread 89 on the cover part 82. The intermediate combustion chamber part is shown having an internal thread 90 arranged to receive a matching threaded part of a fire barrel (not shown). It is shown that the combustion chamber is formed by an annular wall 24 of the intermediate combustion chamber part 81 and a surface of the inlet part 80. It is to be understood that a similar build-up may be held together by welding, gluing or press fitting the parts together.

Although the invention has been described in the above in connection with preferred embodiments of the invention, it will be evident for a person skilled in the art that several modifications are conceivable without departing from the invention as defined by the following claims.

The invention claimed is:

1. Gear cassette for firearms, comprising:

a trigger unit, the trigger unit comprising means for activating firing of the firearm, and a combustion unit comprising:

a combustion chamber part having an inlet end section and an outlet end section and an annular wall arranged between the inlet end section and the outlet end section, the annular wall and the end sections comprising an inner surface and an outer surface, at least one gas inlet and a fire outlet, and at least one spark plug projecting into the combustion chamber, wherein the combustion unit further comprises a gas hose connected to the gas inlet of the combustion chamber part for bringing the combustion chamber in fluid communication with a gas unit comprising at least one gas container, and wherein the trigger unit is adapted to activate firing of the firearm by igniting gas in the combustion chamber, and wherein the spark plug is arranged in the inlet end section of the combustion chamber part.

2. Gear cassette for firearms according to claim 1, wherein the inlet end section and the outlet end section are opposing each other.

3. Gear cassette for firearms according to claim 1, wherein the inlet end section comprises two gas inlets.

4. Gear cassette for firearms according to claim 1, wherein the combustion unit comprises a mixing chamber arranged between the gas inlets and the combustion chamber i.e. downstream from the gas inlets.

5. Gear cassette for firearms according to claim 1, wherein the outer surface of the combustion chamber comprises heat dissipation means.

6. Gear cassette for firearms according to claim 1, wherein the outlet end section comprises a projecting fire stud or fire barrel from the outer surface of the outlet end section, whereby the fire stud or barrel is in fluid communication with the combustion chamber.

7. Gear cassette for firearms according to claim 1, wherein the combustion chamber and/or the gas hose(s) further comprise/comprises at least one solenoid valve for opening and shutting the flow of gas to the combustion chamber.

8. Gear cassette for firearms according to claim 6, wherein the fire barrel/fire stud and/or the combustion chamber comprise/comprises an injector arranged to inject a fluid into the fire barrel/fire stud and/or the combustion chamber.

9. Gear cassette for firearms according to claim 3, wherein the combustion unit comprises at least two gas inlets.

10. Gear cassette for firearms according to claim 9, wherein the combustion unit comprises a gas mixing chamber for mixing a first gas and a second gas.

11. Gear cassette for firearms according to claim 1, wherein the combustion unit comprises more than one solenoid valve and wherein the solenoid valves stay open in different time intervals.

12. Gear cassette for firearms according to claim 1, wherein the pressure in the first gas container and the second gas container are different.

13. Replica firearm comprising a gear cassette according to claim 1.

* * * * *